US005898980A

United States Patent [19]

Havranek et al.

[11] Patent Number: 5,898,980

[45] Date of Patent: May 4, 1999

[54] CASKET HANDLE WITH SEPARATELY DEMOUNTABLE LUG

[75] Inventors: Scott P. Havranek, Fullerton, Calif.; Brandon J. Marquardt, Lake Mills, Wis.; Kwok Siong Teh, Ann Arbor, Mich.

[73] Assignee: Casket Hardware Development, LLC, Galva, Ill.

[21] Appl. No.: 09/065,675

[22] Filed: Apr. 23, 1998

[51] Int. Cl.[6] ..... A61G 17/00

[52] U.S. Cl. ..... 27/27; 27/2; 27/35; 16/112

[58] Field of Search ..... 27/1, 2, 10, 27, 27/35; 16/112, 114 R

[56] References Cited

U.S. PATENT DOCUMENTS

| | | | |
|---|---|---|---|
| 958,114 | 5/1910 | Hammond . | |
| 1,185,655 | 6/1916 | Govro | 116/112 X |
| 1,227,929 | 5/1917 | Ralson | 116/112 X |
| 2,023,211 | 12/1935 | Scholl et al. . | |
| 2,485,833 | 10/1949 | Kendall . | |
| 3,204,286 | 9/1965 | Hillenbrand . | |
| 4,615,085 | 10/1986 | Hartman . | |
| 5,008,990 | 4/1991 | Craft . | |
| 5,144,727 | 9/1992 | Craft | 27/2 |
| 5,309,614 | 5/1994 | MacKirdy . | |
| 5,377,395 | 1/1995 | Maier et al. | 116/112 X |

*Primary Examiner*—Brian K. Green
*Assistant Examiner*—William L. Miller
*Attorney, Agent, or Firm*—Fitch, Even, Tabin & Flannery

[57] ABSTRACT

A casket handle and removable lug (escutcheon plate) combination frees the lug from a fixed connection to the casket wall in common with the connections of the handle. The lug instead is mounted separately upon the casket, employing spring-urged detents engageable with the lug to hold the lug in assembled relation with the handle and the casket.

8 Claims, 3 Drawing Sheets

Fig 1
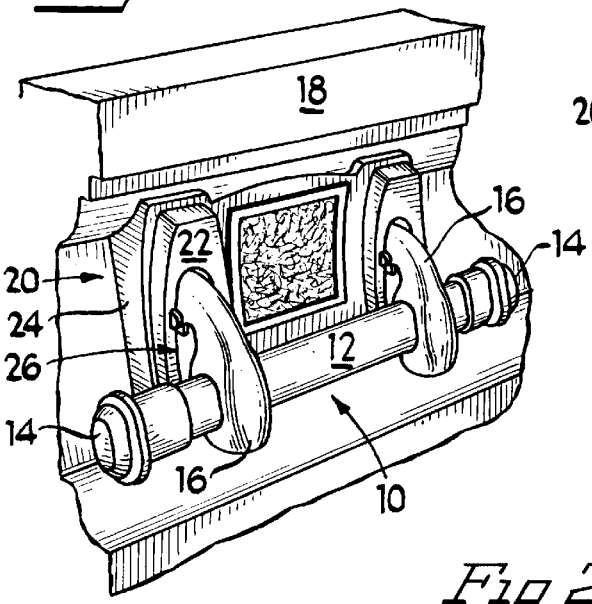
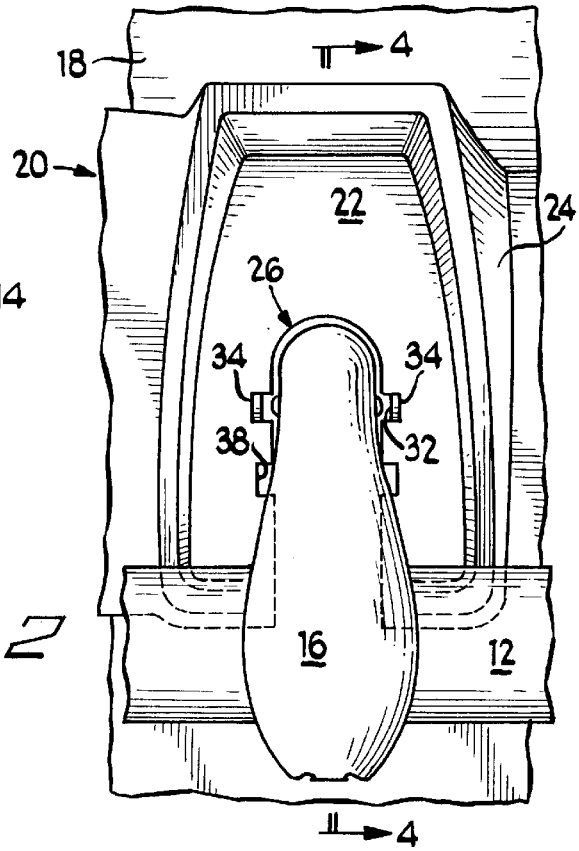
Fig 2
Fig 3
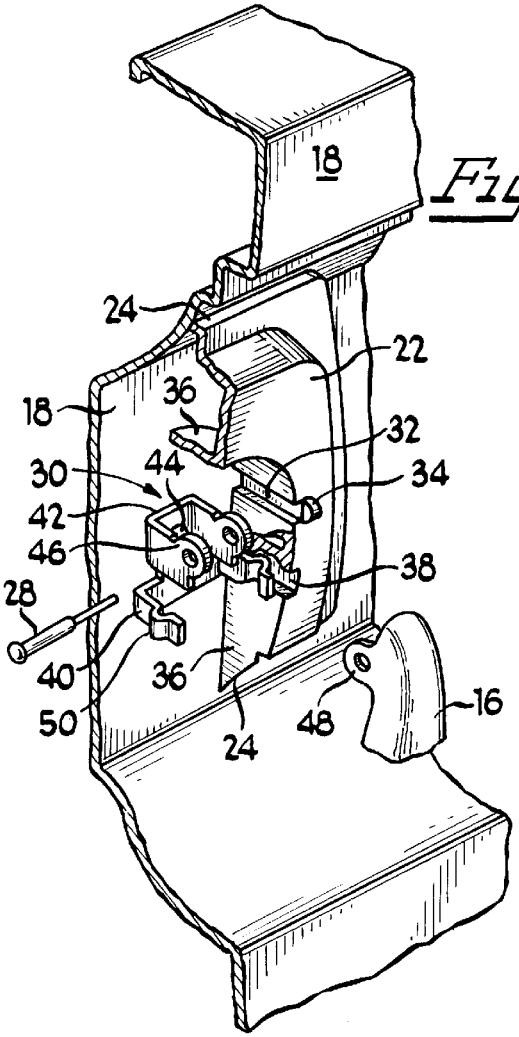
Fig 8
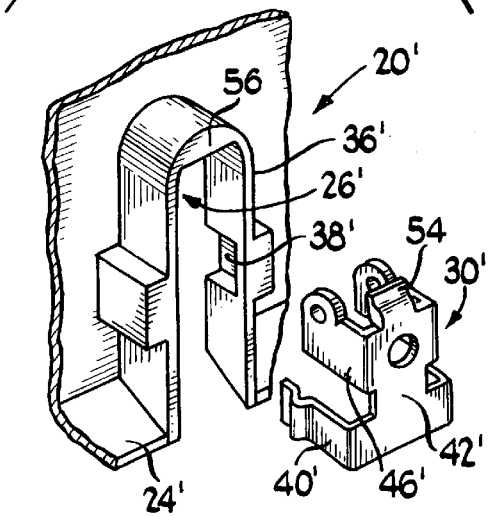

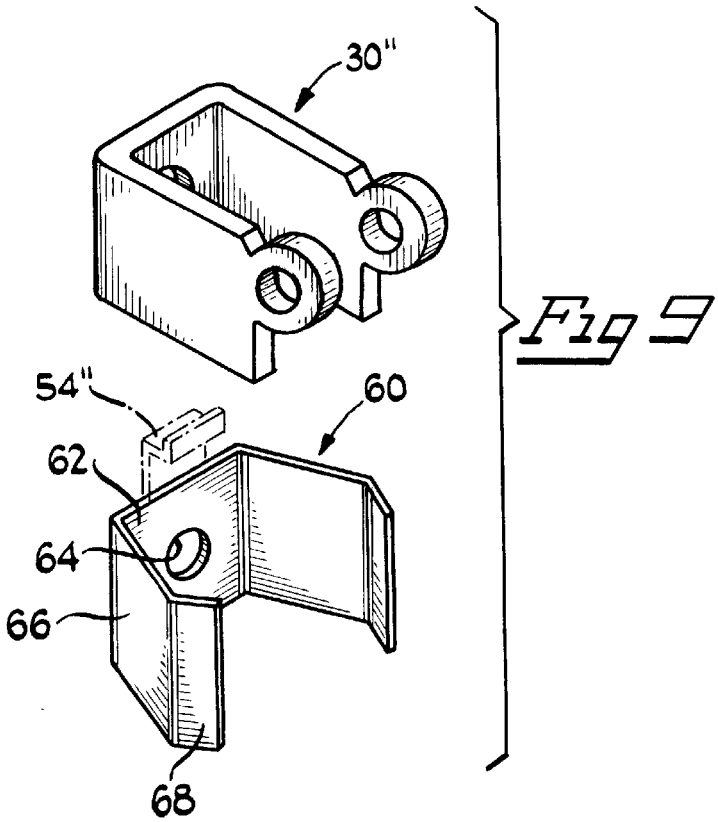
Fig 9
Fig 10
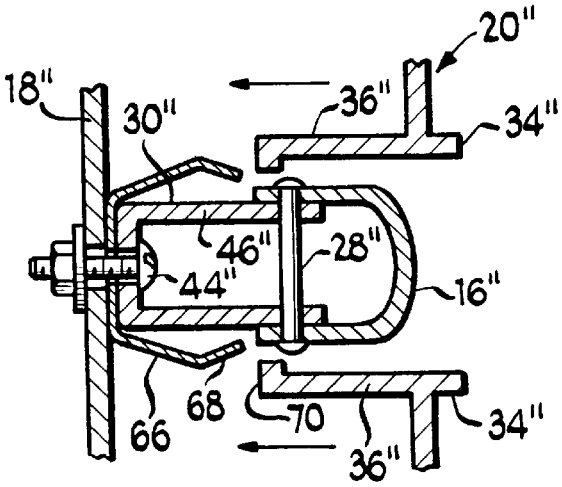
Fig 11
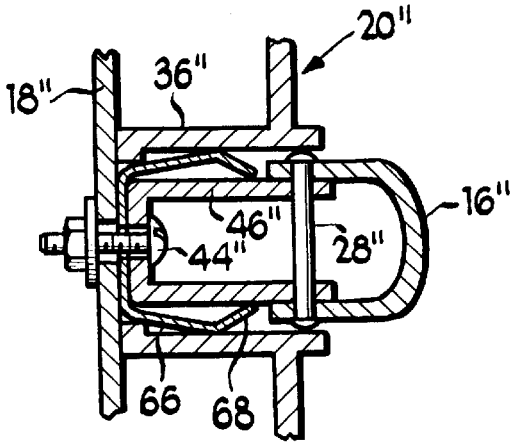

CASKET HANDLE WITH SEPARATELY DEMOUNTABLE LUG

BACKGROUND OF THE INVENTION

1. Field of the Invention

The invention relates to burial caskets, and particularly to the carrying handles thereof and the escutcheon plates employed to cover the attachments of the handles to the walls of the casket.

2. Background and Description of Related Art

These escutcheon plates, commonly called "lugs" in the casket industry, contribute significantly, along with the casket lid and the casket wall contour, to the aesthetic appearance of a casket, the general tone of which is subject to significant alteration merely by the selection of the style of the "lugs".

The lugs also serve the useful purpose of covering and concealing the attachments of the handles to the casket walls. The handles are typically hinged to devises attached to the casket wall, allowing the handles to depend in close proximity to the casket wall when not in use. Where individual handles are provided, they typically comprise a handle bar having two arms each pivoted to a clevis which, in turn, is fastened to the wall of the casket by a bolt passing through the clevis and the casket wall to be secured by a nut on the inside of the casket. Interengageable surfaces of the handle arms and the devises limit the upward and outward swing of the arms to fix the handle in carrying position as though it were attached rigidly to the casket wall.

The lugs, or escutcheon plates, are typically three-dimensional and have a depth from the casket wall sufficient to cover the clevises and usually the pivotal connections of the handle arms thereto. Whether made of die cast or stamped metal, or of molded nonmetallic material, they generally achieve the necessary depth by a peripheral flange which extends from a decorative front surface rearwardly to engage the casket wall.

Heretofore, the lugs and the attachment devises for the handle arms have been secured in common to the casket wall by the same bolts, rendering it necessary to remove the handles in order to remove and exchange lugs to change the appearance of a casket. A more ready interchangeability of lugs would greatly facilitate the distribution and marketing of burial caskets as it would significantly reduce the casket inventory necessary to provide a wide range of aesthetics to suit the tastes of the individual or individuals making the casket selection.

SUMMARY OF THE INVENTION

The invention provides interchangeability of casket lugs by eliminating their dependence upon the clevis-securing bolts to fasten the lug to the casket. The lug instead is removably mounted upon the devises after they, with handle arms attached, are secured to the casket wall. Two downwardly-open apertures in the lug permit the lug to straddle the devises, each of which is provided with resilient detents to engage the inner walls of the lug aperture to secure the lug removably in place upon the devises and against the wall of the casket.

DESCRIPTION OF THE DRAWINGS

The invention is explained by reference to the preferred embodiment thereof illustrated in the accompanying drawings, and to the alternative forms also shown.

In the drawings,

FIG. 1 is a perspective view of the casket handle and lug of the invention and a fragmentary portion of the casket wall, which could be the end wall or side wall;

FIG. 2 is a fragmentary frontal elevation of the handle, handle arm, and lug according to the invention;

FIG. 3 is a fragmentary isometric view of the relationship of the handle-mounting clevis and the decorative lug, showing the detent of the clevis engaged with the depression in the wall of the aperture in the lug;

FIG. 8 is a fragmentary isometric view of an alternative form of the lug and clevis, seen from behind the lug;

FIG. 9 is an exploded assembly of a further alternative, i.e., a clevis with a separable rather than integral detent;

FIG. 10 is a fragmentary sectional view of the assembly of FIG. 9 mounted on the casket wall with the lug poised for assembly therewith; and FIG. 11 is a view similar to FIG. 10, showing the lug assembled with the casket wall and mounting.

DESCRIPTION OF THE PREFERRED EMBODIMENT

Figure 4:
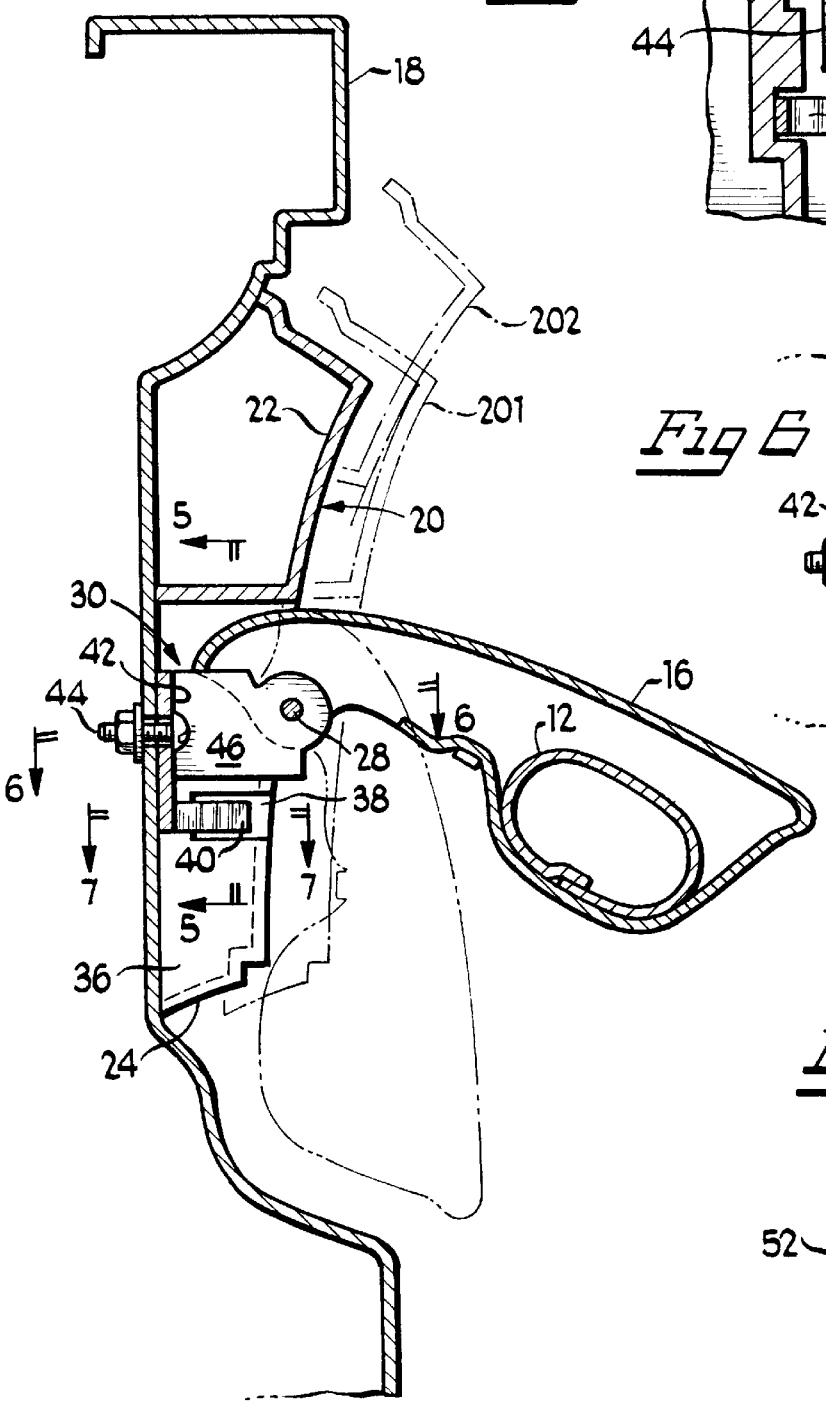
FIG. 4 is a sectional side elevation of the same with the swing arm of the handle in its raised position, and showing by two phantom positions of the lug the procedure for its installation and removal.
Figure 5:
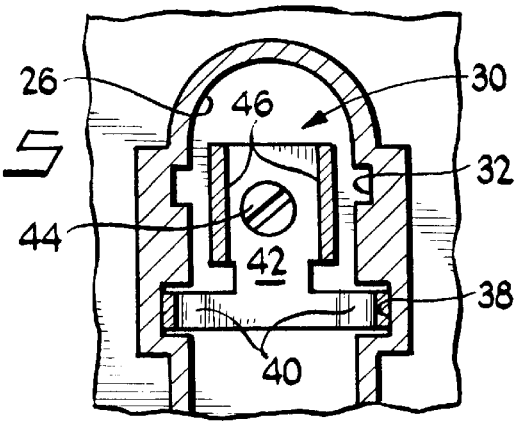
FIGS. 5, 6, and 7 are detailed sectional views taken on the lines 5—5, 6—6, and 7—7 of FIG. 4.
Figure 6:
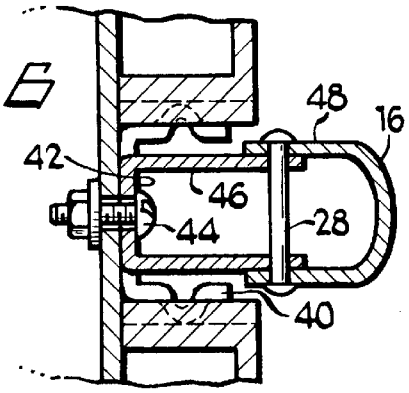

Referring initially to FIGS. 1 and 2 of the drawings, the carrying handle 10 comprises a tubular handle bar 12 provided at each end with decorative end caps 14. The handle bar 12 is attached to swing arms 16, two for each handle, which are pivoted indirectly to the wall of the casket 18 for limited swinging movement from the depending position of FIGS. 1 and 2, to the upwardly raised carrying position of FIG. 4.

The lug 20, illustrated as a sculptured, decorative escutcheon plate 22 is shown as a die casting which is spaced from the wall of the casket 18 by rearwardly-directed, integral peripheral flanges 24 whose edges conform to the casket wall (FIGS. 3 and 4).

At the location of each swing arm 16, the lug 20 is provided with a downwardly open aperture 26 having an arched top conforming to the curvature of the associated swing arm 16, and a width sufficient to accommodate the upper end of the arm 16 with comfortable clearance for the swinging movement of the arm. The sideward protrusion of the heads of the pintle rivet 28 (FIG. 3) which secures the swing arm 16 to its associated clevis 30, is accommodated by a groove 32 in the wall of the aperture 26. When larger clearance about the upper end of the swing arm 16 is acceptable, the groove 32 may be omitted. In either case, the rivet heads themselves are concealed from side view of the swing arms 16 by semicircular protrusions 34 from the escutcheon plate (FIGS. 2 and 3).

Each aperture 26 in the lug takes the shape of a portal defined by a continuous rearwardly extending flange 36, integral with the decorative, outwardly facing escutcheon plate 22 and the underside portion of its peripheral flange 24 (FIGS. 3 and 4). Spaced downwardly from the arched top of the aperture 26 is a further and partial horizontal groove 38 in each of the aperture walls, designed to receive a pair of resilient detent arms 40 of the clevis 30 to which the swing arms 16 are pivoted.

The clevis 30 is stamped from sheet steel and formed to provide a back plate 42 which is pierced to receive an attaching bolt 44 to secure the clevis to the wall of the casket 18. A pair of pivot arms 46, extending forwardly from the back plate 42, are pierced to receive the pintle rivet 28, passed first through pierced ears 48 of the swing arm 16 which flank the pivot arms 46 of the clevis from the outside. The swing arm 16 is likewise formed of sheet steel drawn to a U-shaped cross section and to form a dome at its upper end. The edges of the domed upper end engage the upper edges of the pivot arms 46 of the clevis, to determine the raised carrying position of the handle (FIG. 4).

The detent arms 40 of the clevis 30, seen best in FIG. 3 and FIGS. 5 to 7, are formed integral with the clevis on a downward extension of its back plate 42 below the pivot arms 46. The detent arms 40 extend initially in opposite directions from the back plate 42, and are bent forwardly at a right angle to become spring arms having a further outward-inward bend to form a protrusion 50 adapted to enter the groove 38 in the side wall of the aperture 26 when the groove and detent are at the same height.

Figure 7:
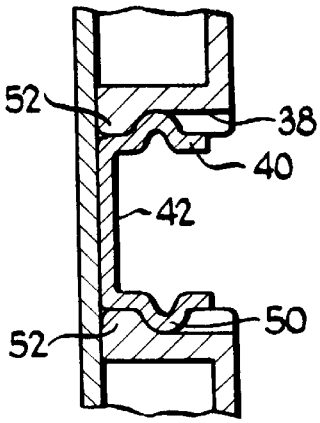

The groove 38 terminates forwardly of the back edge of the aperture flange 36 so as to provide a block of metal 52 whose forward edge is confined by the protrusion 50 of the detent to snug the lug to the wall of the casket (FIG. 7). To ease the entry of the protrusion 50 into and out of the groove 38, the vertical corners of the block 52 are preferably slightly chamfered.

In the described arrangement, the detent arms 40 are susceptible of bending inwardly about the right angle bends in the plane of the back plate of the clevis, and to a lesser extent at the juncture of the detent arms with the back plate 42, the latter when the lug is withdrawn forwardly to disengage it from the detents. The width, or vertical dimension, of the detent arms 40 is therefore chosen in relation to the thickness of the sheet material from which the clevis is formed, and in relation to the elastic limit thereof, to provide a satisfactory degree of spring force to hold the lug in position against the casket wall, in addition to positioning the lug vertically for mating engagement with the contours, if any, of the casket wall, and with due regard to its ready removal by movement directly away from the casket wall initially to unseat the detent protrusions 50 from the grooves 32.

The removal of the lug from assembly with the casket is, as suggested, initiated by a direct forward movement of the lug to unseat the detent protrusions 50 from the grooves 38 in which they rest. That forward movement of the lug is limited by the handle bar 12 and the depending swing arms 16 of the handle, which flare to a width greater than that of the aperture 26 (FIG. 2). When the handle is raised to carrying position, however, as shown in FIG. 4, the range of permissible forward movement is enlarged to permit the withdrawal of the lug forwardly, clear of any interference with the detents 40, and the subsequent lifting of the lug out of association with the handle and its attaching clevises.

The removal of the lug is illustrated by the two phantom outlines thereof in FIG. 4. The outline $\mathbf{20}_1$ shows the lug 20 withdrawn forwardly from the casket wall to disengage the detents 40 from the grooves 38, permitting the lug to be raised out of straddling relation to the swing arms 16 of the handle, as indicated by the further phantom outline $\mathbf{20}_2$. The assembly of the lug with the mounted handle is accomplished by the described sequence of movements in reverse.

The alternative embodiment of FIG. 8 is in all respects similar to that of FIGS. 3 to 7 inclusive, with the added feature of a further interengaged relationship of the lug 20' with the clevis member 30'.

FIG. 8 views the combination of lug 20' and clevis member 30' from the back side of the lug, and with the two members separated. The clevis member 30' differs from that of FIGS. 3 to 7 in that the back plate 42' of the clevis is extended upwardly above the pivot arms 46', and bent forwardly and upwardly as a hook 54. The rearwardly extending flange 36' of the aperture 26', at the arched top thereof, has a hood, or downwardly extending lip 56, which is adapted to be seated upon the hook 54 of the clevis to provide three-point engagement of the lug and clevis, if permitted by the contour of the casket wall. That is, where the degree of overhang of the casket wall contour and the cross-sectional configuration of the lug permit use of the alternative form, the lug 20' may be seated first upon the forwardly-extending hooks 54 of the devises 30', two associated with each lug, as the lug is lowered to straddle the swing arms of the handle, and then swung inwardly at the bottom to engage the detents 40' with the recesses 38' in the aperture-defining flange 36', which function as do their counterparts in the preferred embodiment.

While the spring arm form of detent integral with the arm-mounting clevis, as shown in FIGS. 1 to 8, simplifies assembly, it may also represent a further outlay for tooling and delay placing the invention into use. A very satisfactory interim arrangement will be found in the further alternative form of the invention seen in FIGS. 9 to 11.

There the swing-arm mounting clevis 30" is provided with a wrap-around detent 60 which is U-shaped in plan and, like the clevis, is pierced in its back plate 62 to provide a hole 64 for co-mounting on the casket wall by the same bolt 44" which secures the clevis 30". The detent is formed of spring brass with its arms 66 spaced to embrace the clevis in comfortable fit between them with their respective mounting holes in registry.

The arms 66 of the detent diverge from the back plate 62 when in the unstressed condition, as shown in FIG. 10, i.e., before the lug 20" is emplaced thereon, and are bent slightly inwardly in their forwardmost reach to provide lead-in bevels 68 for the portal flanges 36" of the lug when presented for assembly.

For this form of detent, the portal flanges 36" need not be grooved as in FIGS. 1 to 8, but are provided with inwardly-directed opposing flanges 70 at the back of the portal.

Thus, when the lug 20" is pushed rearwardly toward the casket wall 18", as indicated by the arrows in FIG. 10, the arms 66 of the detent are forced inwardly into contact with the clevis arms 46", and may remain so engaged after the bends of the arms 66" pass through the restrictive obstruction of the opposing flanges 70 and re-expand into contact with the portal flanges 36". Properly designed and dimensioned, the detent arms 66 exert outward force upon the portal flanges 36" by their resilient resistance to being bent inwardly about their integral connections to the back plate 62, and by the resistance of the bends of the detent arms to being flattened. The result is firm spring contact of the detent arms 66 with portal flanges 36" to hold the lug 20" in the FIG. 11 position, tightly abutting the casket wall 18", concealing the clevis 30" and the adjoining upper end of the handle arm 16", the pintle rivet 28" being covered from side view by the circular protrusions 34", like those seen in FIGS. 2 and 3.

If desired, the detent 60 may be provided with a forwardly bent upward extension 54" to serve the same purpose as the hook 54 extending upwardly from the back plate of the clevis 30' of FIG. 8, namely, to provide a positioning rest for a downwardly extending hood, such as the hood 56 of the lug portal shown in FIG. 8.

It will be appreciated from the foregoing description of structure and operation that the lug, clevis and detent combination of the invention isolate the mounting of the lug from the connection of the swing arms of the handle to the casket. By associating the lugs removably with the swing-arm devises independently of the attachment of the latter to the casket wall, the invention makes possible the mounting and demounting of the lugs without disturbing the load-carrying connections of the handles to the casket through the clevises, which alone, and independently of their connections to the casket, demountably support the lugs.

While it is convenient, when using a clevis as the arm pivot, to form the detents integral therewith in the form first shown, other forms of detent are feasible, whether or not integral with the clevis or other pivotal mounting of the arm, as shown, for example, by the separate spring clip detent of FIGS. 9 to 11.

The detent arrangement, moreover, could be mounted on the casket wall independently of the clevis, but the illustrated construction, i.e., with detents and clevis formed from the same stamping, or co-mounted on the casket wall, has obvious advantages of simplicity, economy of manufacture and of assembly.

The arrangement of the invention greatly facilitates the interchangeability of the decorative lugs of a casket, enabling the mortician or other supplier to greatly extend the range of decorative effects that can be achieved with a relatively limited inventory of caskets.

The features of the invention believed new and patentable are set forth in the following claims.

What is claimed is:

1. A carrying handle assembly for a casket, the assembly including spaced arms each with a load-bearing connection mountable on a wall of the casket, and a decorative escutcheon plate associated with at least one of said arms for normally concealing said connection, the improvement of said assembly comprising: said escutcheon plate being mountable to and demountable from the casket without disconnecting the arm from the casket, said escutcheon plate having formed therein a downwardly-open aperture to straddle said arm and said connection, said aperture being defined between opposed spaced walls formed integrally with said escutcheon plate and extending from said escutcheon plate rearwardly toward said casket wall, said connection having associated therewith a pair of laterally spaced detents resiliently urged against said opposed walls of said aperture in separable holding engagement to maintain said escutcheon plate in association with said arm and said casket wall.

2. The assembly of claim 1 wherein the separation of said detents from said holding engagement by movement of the escutcheon plate away from the casket wall is resisted by opposed obstructions protruding inwardly from said spaced aperture walls to engage said resiliently urged detents.

3. The assembly of claim 2 wherein the spaced aperture walls are provided with depressions therein to receive said detents and to resist vertical movement of said escutcheon plate when said detents are seated in said depressions.

4. The assembly of claim 2 wherein the connection of said arm to said casket wall is a clevis having spaced arms, said clevis being securable to the casket wall with the spaced arms of the clevis extending away from said wall, said arm of said handle is pivoted to the spaced arms of said clevis with limited upward swinging movement from a depending position to an extended carrying position, and said detents are associated with said clevis.

5. The assembly of claim 4 wherein said clevis is formed of sheet metal in U-shaped form to include an integral back plate seatable against the casket wall and the spaced arms of the clevis are bent forwardly from said back plate, said detents take the form of arms formed integrally with said clevis from a downward extension of said back plate, said detent arms being spaced more widely than the clevis arms and being formed at distal ends thereof to be cammed inwardly by said obstructions and to spring outwardly into depressions formed in said spaced apart aperture walls of said escutcheon plate as the escutcheon plate is moved inwardly toward the casket wall, said depressions taking the form of grooves extending forwardly in the aperture walls from said obstructions.

6. The assembly of claim 5 wherein the back plate of the clevis is provided with an upward extension which is bent forwardly above the clevis arms to form a seat, and the associated aperture of the escutcheon plate is formed as an arched portal having therein a depending flange engageable with said seat to limit downward movement of the escutcheon plate relative to the casket wall when mounting the plate thereon.

7. The assembly of claim 4 wherein said clevis is formed of sheet metal in U-shaped form to include a back plate seatable against the casket wall and the spaced clevis arms are bent forwardly from said back plate, said back plate having therein a hole for a bolt to secure the back plate to the casket wall, said detents being formed separately from said clevis from spring sheet metal bent in U-shape conformable to the exterior of said clevis with spring detent arms extending forwardly from an integral back plate in outer flanking relation to said clevis arms, said detent back plate having a bolt hole in registry with the bolt hole of the clevis back plate, and the U-shaped detent and said clevis being securable to the casket wall by a single bolt with the detent arms embracing the clevis arms, said detent arms diverging from said integral back plate thereof to engage said spaced aperture walls, and being bent inwardly at distal ends thereof to form a lead-in bevel to spring by said obstructions when the escutcheon plate is positioned to straddle the arm of said handle and is moved rearwardly to engage said detents.

8. The assembly of claim 7 wherein the back plate of the spring detent is extended upwardly above the associated clevis and bent forwardly to form a seat, and the aperture of the escutcheon plate is arched at the top and provided with a depending flange engageable with said seat to limit downward movement of the escutcheon plate relative to the casket wall when mounting the plate thereon.

* * * * *